United States Patent [19]

Kando

[11] Patent Number: 4,625,398

[45] Date of Patent: Dec. 2, 1986

[54] APPARATUS FOR MANUFACTURING BIDIRECTIONALLY OPENABLE SLIDE FASTENERS

[75] Inventor: Akiyoshi Kando, Uozu, Japan

[73] Assignee: Yoshida Kogyo K. K., Tokyo, Japan

[21] Appl. No.: 730,177

[22] Filed: May 3, 1985

[30] Foreign Application Priority Data

May 11, 1984 [JP] Japan ..... 59-94128
May 11, 1984 [JP] Japan ..... 59-94129

[51] Int. Cl.[4] ..... A41H 37/06
[52] U.S. Cl. ..... 29/768; 29/33.2
[58] Field of Search ..... 29/33.2, 408–410, 29/766–770

[56] References Cited

U.S. PATENT DOCUMENTS

| | | | |
|---|---|---|---|
| 3,714,698 | 2/1973 | Fukuroi | 29/33.2 |
| 4,494,293 | 1/1985 | Kawakami | 29/408 |
| 4,495,695 | 1/1985 | Umino | 29/408 |
| 4,520,544 | 6/1985 | Morita et al. | 29/408 |

FOREIGN PATENT DOCUMENTS 56-85301 7/1981 Japan .

*Primary Examiner*—Howard N. Goldberg
*Assistant Examiner*—Steven Nichols
*Attorney, Agent, or Firm*—Hill, Van Santen, Steadman & Simpson

[57] ABSTRACT

An apparatus for automatically manufacturing a bidirectionally openable slide fastener includes a pin attachment unit for attaching a pin to an end of one of a pair of slide fastener stringers, a pair of first and second slider attachment units for attaching first and second sliders, respectively, to the stringers, and a box pin attachment unit for attaching a box pin to an end of the other slide fastener stringer. The slide fastener stringers are fed by a gripper mechanism along a feed path as the pin, the sliders, and the box pin are successively attached to the slide fastener stringers. Finally, the slide fastener stringers are cut off by a cutter unit into a bidirectionally openable slide fastener of a desired length.

8 Claims, 18 Drawing Figures

APPARATUS FOR MANUFACTURING BIDIRECTIONALLY OPENABLE SLIDE FASTENERS

BACKGROUND OF THE INVENTION

1. Field of the Invention:

The present invention relates to an apparatus for manufacturing bidirectionally openable slide fasteners, i.e., slide fasteners having two oppositely directed sliders and a separable box and pin.

2. Prior Art:

One known method of manufacturing bidirectionally openable slide fasteners is disclosed in Japanese Laid-Open Patent Publication No. 56-85301, for example. According to the disclosed method, first and second sliders are successively threaded over a pair of slide fastener stringers while the latter are being fed along, and then a box pin and a pin are attached respectively to the stringers. Another method, which is an improvement over the above prior method, has been devised as disclosed in Japanese Patent Application No. 58-132095 filed by the present applicant. This method comprises attaching a pin to one of slide fastener stringers before first and second sliders are threaded over the stringers, and then attaching a box pin to the other stringer after the sliders have been threaded. However, there has been proposed no apparatus for automatically manufacturing bidirectionally openable slide fasteners. It has been conventional practice to manually attach sliders, a pin, and a box pin to slide fastener stringers respectively on dedicated machines. Bidirectionally openable slide fasteners with right-hand and left-hand pins have been manufactured with jigs designed respectively for attaching right-hand and left-hand pins.

SUMMARY OF THE INVENTION

It is an object of the present invention to provide an apparatus for automatically manufacturing bidirectionally openable slide fasteners without manual intervention.

Another object of the present invention is to provide an apparatus for automatically manufacturing bidirectionally openable slide fasteners having either right-hand or left-hand pins that are freely selectable, efficiently without using any special jigs for attachment of right-hand or left-hand pins.

According to the present invention, an apparatus for manufacturing a bidirectionally openable slide fastener includes a pin attachment unit for attaching a pin to an end of one of slide fastener stringers, a first slider attachment unit for threading a first slider over the slide fastener stringers, a second slider attachment unit for threading a second slider over the slide fastener stringers, and a box pin attachment unit for attaching a box pin to an end of the other slide fastener stringer. The slide fastener stringers are gripped and fed by a gripper mechanism along a feed path as the pin, the sliders, and the box pin are successively attached to the slide fastener stringers. A cutter unit finally cuts off the slide fastener stringers across an element-free space to produce a completed bidirectionally openable slide fastener. Since the pin and the box pin can be applied selectively to desired slide fastener stringers, the apparatus can produce bidirectionally openable slide fasteners with right-hand and left-hand pins freely and efficiently without using any special jigs. Therefore, the apparatus of the invention can meet varying commercial demands for bidirectionally openable slide fasteners with right-hand and left-hand pins.

The above and other objects, features and advantages of the present invention will become more apparent from the following description when taken in conjunction with the accompanying drawings in which a preferred embodiment of the present invention is shown by way of illustrative example.

DETAILED DESCRIPTION

Figure 3:
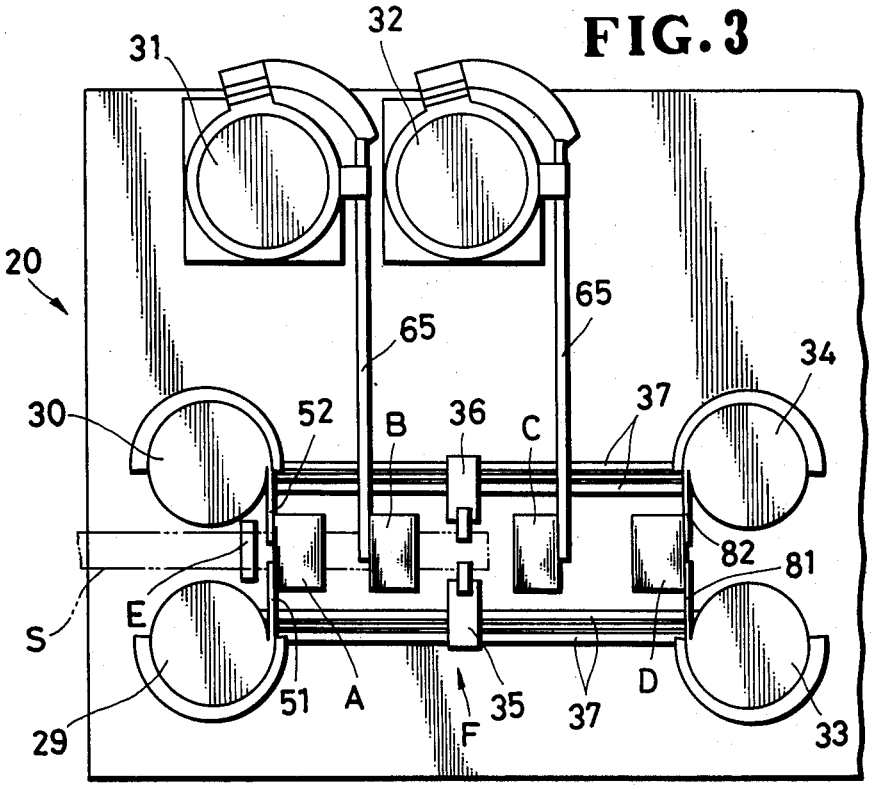
FIG. 3 is a plan view of an apparatus according to the present invention.

The principles of the present invention are particularly advantageous when embodied in an apparatus, generally designated by the reference numeral 20, shown in FIG. 3.

Prior to describing the apparatus 20 of the present invention, two types of bidirectionally openable slide fasteners will be described with reference to FIGS. 1 and 2.

Figure 1:
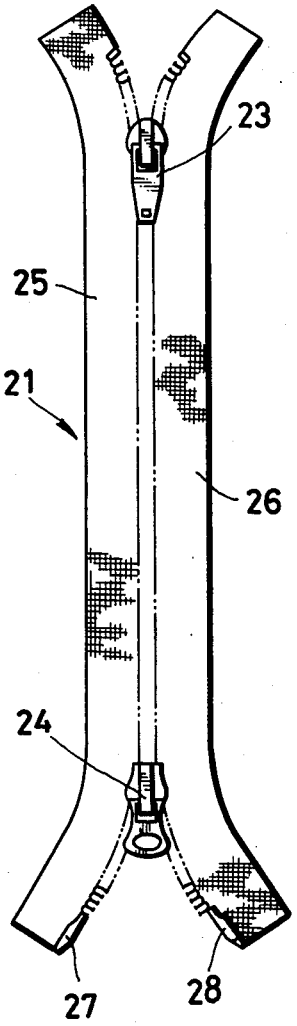
FIGS. 1 and 2 are plan views of completed bidirectionally openable slide fasteners with right-hand and left-hand pins, respectively.
Figure 2:
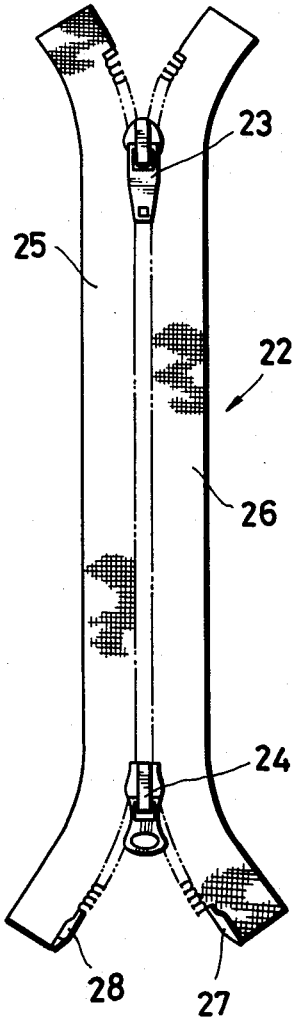

FIGS. 1 and 2 illustrate bidirectionally openable slide fasteners 21, 22, respectively, each having a pair of oppositely directed sliders 23, 24 mounted on a pair of slide fastener stringers 25, 26 and movable independently to open the slide fasteners 21, 22 in opposite directions. The slide fastener 21 shown in FIG. 1 also includes a pin 27 attached to an end of the stringer 25 and a box pin 28 attached to an end of the stringer 26, the box pin 28 having a stopper. Conversely, the slide fastener 22 shown in FIG. 2 has a pin 27 attached to an end of the stringer 26 and a box pin 28 attached to an end of the stringer 25, the box pin 28 having a stopper. For operating the slide fastener 21, the stringer 25 is normally gripped by a right hand to insert the pin 27 into a box associated with the box pin 28. The slide fastener 21 is used chiefly in Japan and referred to as a slide fastener with a right-hand pin. The slide fastener 22 is used chiefly in the United States and referred to as a slide fastener with a left-hand pin since the stringer 26 is normally manipulated by a left hand to insert the pin 27 into a box coupled to the box pin 28.

The above two different slide fasteners 21, 22 have conventionally been manufactured using different jigs of respective designs. According to the present invention, however, the slide fasteners with right-hand and left-hand pins can automatically be manufactured by the apparatus 20.

Figure 4:
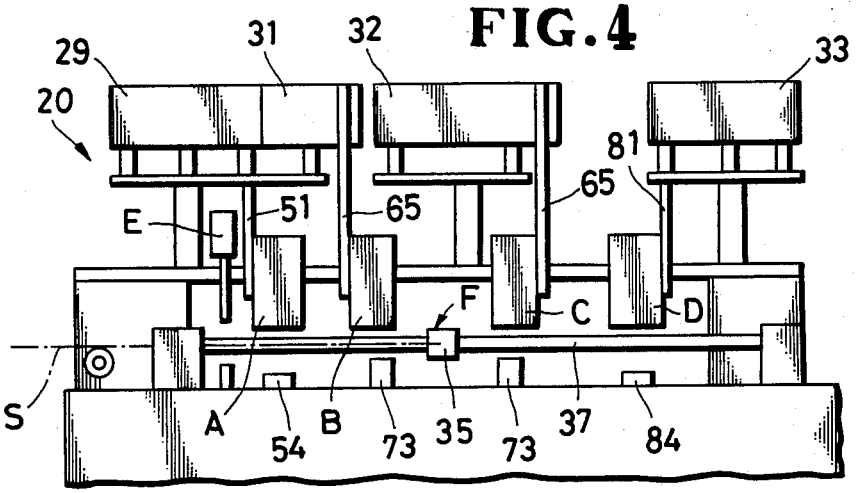
FIG. 4 is a side elevational view of the apparatus shown in FIG. 3.

As illustrated in FIGS. 3 and 4, the apparatus 20 processes a pair of stringers S (identical to the stringers 25, 26 shown in FIGS. 1 and 2) as they are fed along in a rightward direction (FIGS. 3 and 4) along a feed path. The stringers S are gripped and transferred by a gripper mechanism F. The apparatus 20 also includes a pin attachment unit A, a first slider attachment unit B, a second slider attachment unit C, and a box pin attachment unit D all disposed on the feed path at longitudinally spaced intervals for attaching various components to the stringers S as they are transferred through the apparatus 20. The stringers S are finally cut off into a bidirectionally openable slide fastener by a cutter unit E.

More specifically, the pin attachment unit A is supplied with a pin from one of a pair of pin feeders 29, 30 dependent on whether a slide fastener to be manufactured should be provided with a right-hand pin or a left-hand pin. Then, the pin attachment unit A applies the supplied pin to an end of one of the stringers. Thereafter, a first slider (identical to the slider 23 shown in FIGS. 1 and 2) is supplied from a first slider feeder 31 to the first slider attachment unit B and attached thereby to the stringers, and a second slider (identical to the slider 24 shown in FIGS. 1 and 2) is supplied from a second slider feeder 32 to the second slider attachment unit C and attached thereby to the stringers. The stringers with the first and second sliders 23, 24 are thus combined into a slide fastener chain. A box pin is supplied to the box pin attachment unit D from one of a pair of box pin feeders 33, 34 dependent on whether a slide fastener should have a right-hand or a left-hand pin, and attached by the box pin attachment unit D to an end of the other stringer. Finally, the fastener chain is cut off by the cutter unit E across an element-free gap in the chain into a completed bidirectionally openable slide fastener, which is discharged from the apparatus 20.

The mechanism and units of the apparatus will be described.

Figure 5:
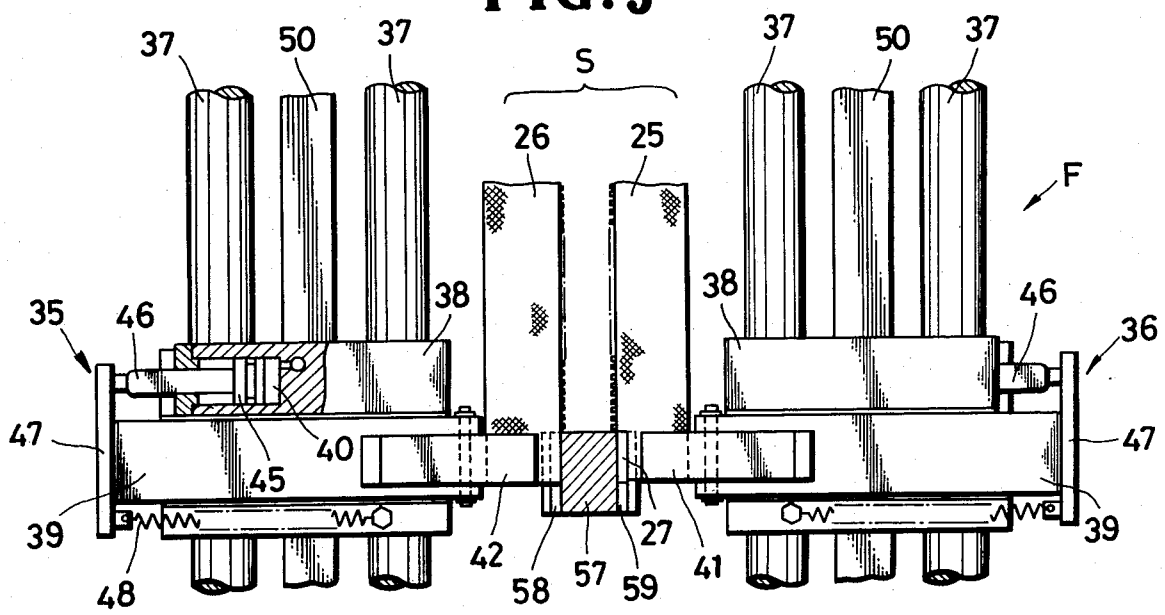
FIG. 5 is a plan view of a gripper mechanism in the apparatus.
Figure 6:
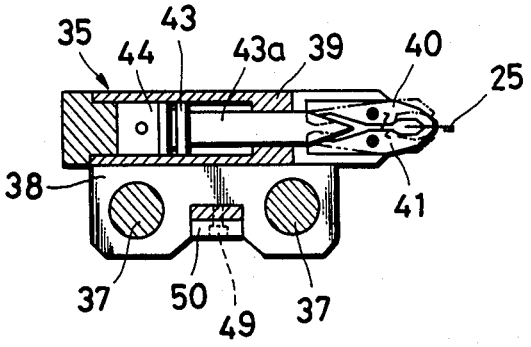
FIG. 6 is a side elevational view, partly in cross section, of a gripper of the gripper mechanism shown in FIG. 5.

As shown in FIG. 5, the gripper mechanism F comprises a pair of laterally spaced grippers 35, 36 slidably movable on and along two pairs of longitudinal guide rails 37 extending along the stringer feed path alongside of the pin attachment unit A, the first and second slider attachment units B, C, and the box pin attachment unit D. Since the grippers 35, 36 are symmetrically constructed, one of the grippers 35 will be described. As illustrated in FIG. 5, the gripper 35 is composed of a slide base 38 slidable on and along the guide rails 37, a gripper base 39 mounted on the slide base 38 and laterally movable by a fluid cylinder 40 for adjusting the clearance gap between the stringers 25, 26, and a pair of upper and lower gripper jaws 41, 42 (FIG. 6) pivotably mounted on an end of the gripper base 39 for gripping the stringer 25. As illustrated in FIG. 6, the gripper jaws 41, 42 have rear end portions engaged by a wedge-shaped end of a rod 43*a* coupled to a piston 43 slidably disposed in a fluid cylinder 44 defined in the gripper base 39. Thus, the gripper jaws 41, 42 can be opened and closed to release and grip the stringer 25 by introducing a fluid into and discharging a fluid from the fluid cylinder 44. The fluid cylinder 40 for adjusting the clearance gap between the stringers 25, 26 is defined in the slide base 38 and has a piston 45 to which there is coupled a piston rod 46 connected to a joint plate 47 joined to a rear end of the gripper base 39. Therefore, the gripper base 39 can be laterally moved in a direction across the guide rails 37 by introducing a fluid into or discharging a fluid from the fluid cylinder 40. The gripper base 39 is normally urged to move inwardly toward the stringer 25 by a spring 48 acting between the joint plate 47 and the slide base 38. The slide base 38 is fastened by screws 49 to a belt 50 extending along the guide rails 37 and coupled to a drive device (not shown). The slide base 38 can be slidably moved along the guide rails 37 by the belt 50.

Figure 7:
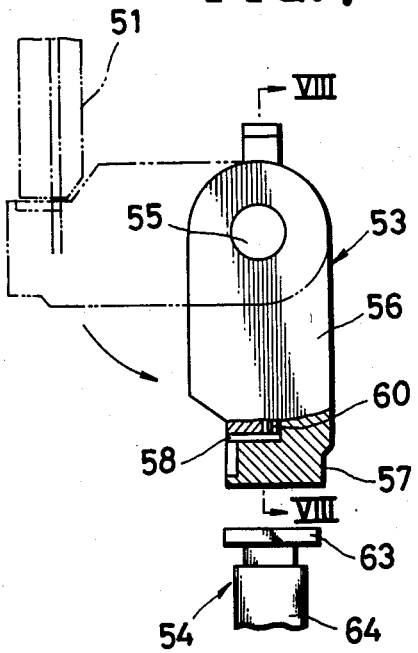
FIG. 7 is a side elevational view, partly in cross section, of a pin attachment unit.
Figure 8:
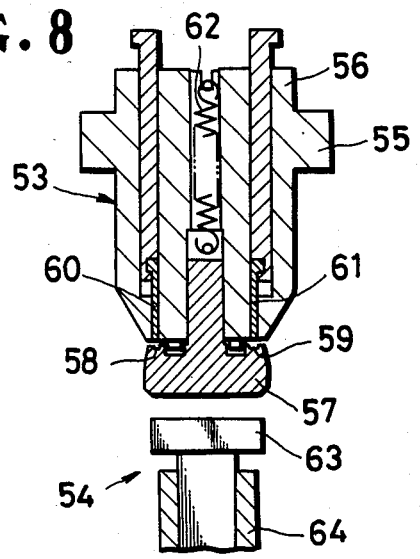
FIG. 8 is a cross-sectional view taken along line VIII—VIII of FIG. 7.

The pin attachment unit A is disposed on the feed path for the stringers as shown in FIG. 3. The pin feeders 29, 30 for feeding left-hand and right-hand pins, respectively, have supply chutes 51, 52 coupled to the pin attachment unit A for supplying a selected pin to the pin attachment unit A, which attaches the supplied pin to one of the stringers. As illustrated in FIGS. 7 and 8, the pin attachment unit A is composed of a pin holder 53 and a die assembly 54 disposed below the pin holder 53. The pin holder 53 is angularly movable about a shaft 55 between a first horizontal position, indicated by the two-dot-and-dash lines in FIG. 7, to receive one of left-hand and right-hand pins from the supply chutes (only the supply chute 51 is shown in FIG. 7), and a second vertical position, indicated by the solid lines, to apply the supplied pin to one of the stringers. The pin holder 53 includes a holder body 56 and a pin support 57 movably supported on the holder body 56 and defining a pair of pin support slots 58, 59 opening upwardly toward the holder body 56 for accommodating left-hand and right-hand pins respectively therein. The pin holder 53 also has a pair of vertical punches 60, 61 disposed in alignment with the pin support slots 58, 59, respectively. The pin support 57 is normally urged by a spring 62 to move upwardly when the pin holder 53 is disposed vertically as shown in FIG. 7. The die assembly 54 includes a die 63 supported on a die holder 64.

FIG. 5 shows the stringers 25, 26 gripped by the grippers 35, 36, the stringers 25, 26 being turned upside down while they are processed by the apparatus 20. The right-hand pin 27 is shown as being applied to the stringer 25. More specifically, the pin holder 53 receives the pin 27 from the chute 52 in the first horizontal position and is then turned downwardly toward the second vertical position. The stringers 25, 26 are fed along by the gripper mechanism F until the ends of the stringers 25, 26 are inserted into a position between the holder body 56 and the pin support 57 in vertical alignment with the punches 60, 61. At this time, the end of the stringer 25 is inserted into a slot in the pin 27. Then, the die 63 is moved upwardly by a suitable means (not shown) to press the pin support 57 upwardly, and simultaneously the punches 60, 61 are lowered by a suitable means (not shown) to attach the pin 27 to the end of the stringer 25 by staking. Thereafter, the die 63 is lowered and the pin support 57 is also depressed by a suitable means (not shown) to lower the pin support slots 58, 59, whereupon the stringers 25, 26, with the pin 27 attached to one of them, can pass through the pin holder 53. After one bidirectionally openable slide fastener has been completed, the pin support 57 is raised to restore the pin support slots 58, 59 in readiness for attachment of a next pin.

The first and second slider attachment units B and C will now be described. Although the slider attachment units B and C are supplied with the oppositely directed sliders 23, 24, they are of the same construction. Therefore, only the construction of the first slider attachment unit B will be described.

Figure 9:
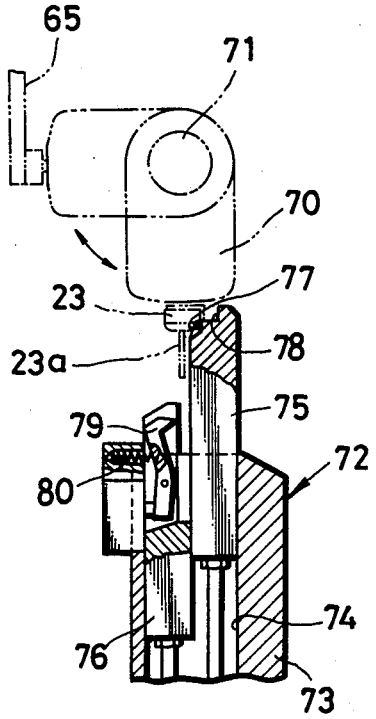
FIGS. 9 and 10 are cross-sectional views of a first slider attachment unit.
Figure 10:
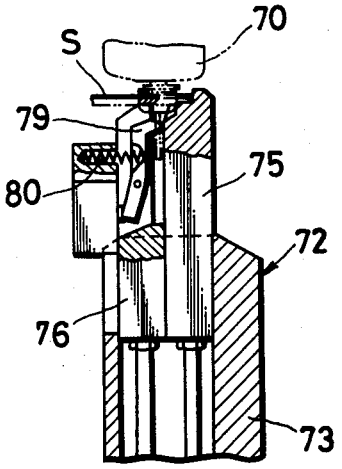

As shown in FIGS. 9 and 10, the first slider attachment unit B receives a slider 23 from a chute 65 connected to the first slider feeder 31, transfers the received slider 23 into the stringer feed path, and threads the slider 23 over the stringers 25, 26. The first slider attachment unit B comprises a slider feeder 70 angularly movable about a shaft 71 between a first horizontal position for receiving the slider 23 from the chute 65 and a second vertical position for supporting the slider 23, and a slider holder 72 for supporting the slider 23 between itself and the slider feeder 70. The slider feeder 70 has a clamp (not shown) for gripping the slider 23. The slider holder 72 is disposed below the slider feeder 70, and comprises a holder base 73 having a vertical slot 74, a stopper block 75 vertically movably disposed in the vertical slot 74 and actuatable by a fluid cylinder (not shown), and a locking block 76 vertically movably disposed in the vertical slot 74 adjacent to the stopper block 75 and actuatable by a fluid cylinder (not shown). The stopper block 75 has a slider rest 77 and a stringer stop 78 on its upper end. The locking block 76 includes a pivotable locking lever 79 biased by a spring 80 for locking a pull tab 23*a* of the slider 23. When the locking block 76 is moved upwardly, the locking lever 79 engages and lowers the pull tab 23*a* under the resiliency of the spring 80 to support the slider 23 stably on the slider rest 77. Where the slider 23 is of the automatic locking type, the slider 23 is unlocked when the pull tab 23*a* is lowered by the locking lever 79, thus allowing the stringers to pass through the slider 23 smoothly. After the stringers 25, 26 are threaded through the slider 23, the stopper block 75 is lowered and the locking lever 79 is released from the pull tab 23*a*. The stringers 25, 26 are fed along through the slider 23 held by the clamp on the slider feeder 70 and the upper end of the locking block 76, during which time the stringers 25, 26 are progressively interengaged by the slider 23. In the slider attachment unit C, however, the slider 24 is directed in an opposite direction, and the stringers 25, 26 as they pass through the slider 24 are progressively disengaged from each other. When the slide fastener is finished and top ends thereof reach the slider attachment unit B, the locking block 76 is lowered and the slider feeder 70 is angularly moved upwardly to the first horizontal position to receive a next slider.

Figure 11:
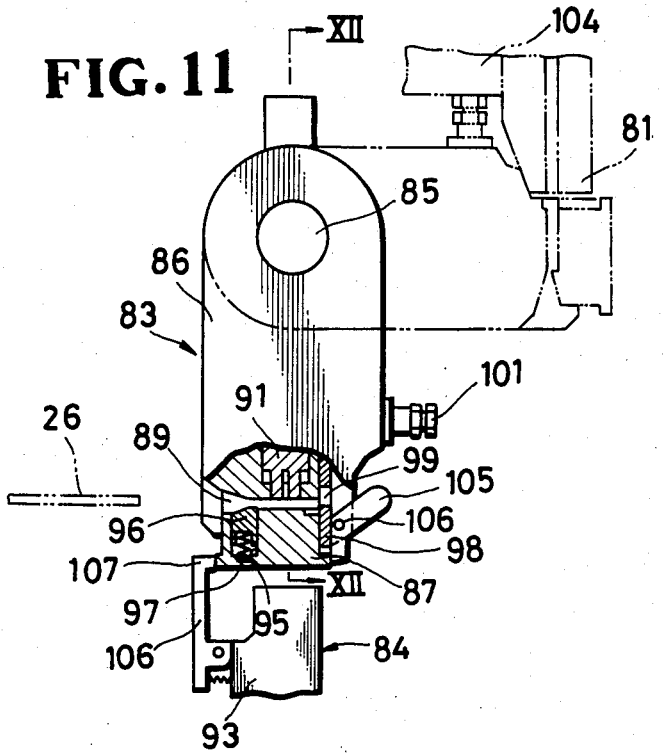
FIG. 11 is a side elevational view, partly in cross section, of a box pin attachment unit.
Figure 12:
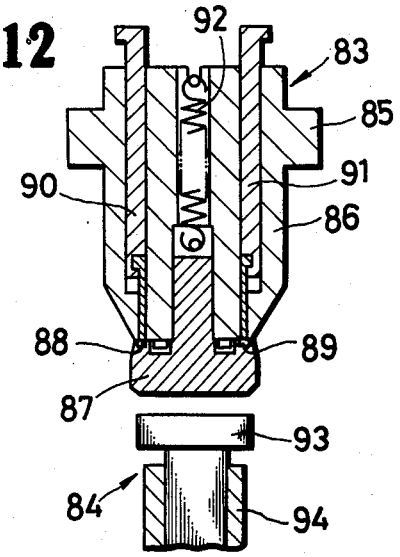
FIG. 12 is a cross-sectional view taken along line XII—XII of FIG. 11.

The box pin attachment unit D is connected to chutes 81, 82 extending from the box pin feeders 33, 34, respectively. A box pin 28 is supplied to the box pin attachment unit D from the box pin feeder 33 when the pin 27 has been supplied from the pin feeder 30, and a box pin 28 is supplied to the box pin attachment unit D from the box pin feeder 34 when the pin 27 has been supplied from the pin feeder 29. As illustrated in FIGS. 11 and 12, the box pin attachment unit D comprises a box pin holder 83 and a die assembly 84 disposed below the pin holder 83. The box pin holder 83 is angularly movable about a shaft 85 between a first horizontal position, indicated by the two-dot-and-dash lines in FIG. 11, to receive a box pin from a selected one of the supply chutes (only the supply chute 81 is shown in FIG. 11), and a second vertical position, indicated by the solid lines, to apply the supplied box pin to the other stringer than the stringer to which the pin 27 has already been attached. The chutes 81, 82 are positioned downstream of the box pin holder 83 in the direction of the stringer feed path as shown in FIGS. 1 and 11 and upwardly of the die assembly 84, so that the box pin holder 83 can swing back upwardly out of the feed path into the first horizontal position, thereby allowing the attached box pin 28 to pass through the box pin attachment unit D. The box pin holder 83 includes a holder body 86 and a box pin support 87 movably supported on the holder body 86 and defining a pair of box pin support slots 88, 89 opening upwardly toward the holder body 86 for accommodating box pins respectively therein. The box pin holder 83 also has a pair of vertical punches 90, 91 disposed in alignment with the pin support slots 88, 89, respectively. The box pin support 87 is normally urged by a spring 92 to move upwardly when the box pin holder 83 is disposed vertically as shown in FIG. 11. The die assembly 84 includes a die 93 supported on a die holder 94.

Figure 15:
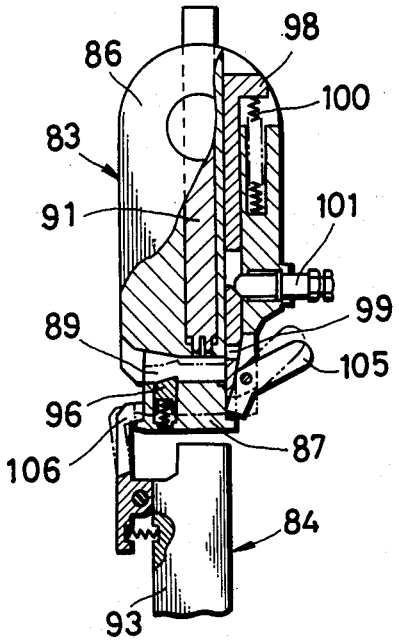

As shown in FIGS. 11 and 12, the box pin support 87 has an upwardly opening hole 95 housing therein a tapered gate 96 urged to move upwardly into the box pin support slot 89 under the resiliency of a spring 97. Although not shown, there is a second similar gate mounted in the box pin support 87 and spring-biased into the box pin support slot 88. A shutter 98 is slidably mounted in the box pin holder 83 and the box pin support 87 across the box pin support slot 89. A similar shutter, not shown, extends across the other box pin support slot 88. The gate 96 and the shutter 98 cooperate with each other in retaining a box pin 28 within the box pin support slot 89. More specifically, the gate 96 serves to prevent the supplied box pin 28 from dropping out of the box pin support slot 89 and to guide the leading end of the stringer with a tapered upper end thereof. The shutter 98 has a hole 99 therethrough, the hole 99 being brought into registration with the box pin support slot 89 when a box pin 28 is to be supplied into the box pin support slot 89. The shutter 98 is normally urged by a spring 100 (FIGS. 13–16) in a direction to displace the hole 99 out of registration with the box pin support slot 89. The holder body 86 supports a presser pin 101 having a rounded end 102 engaging with a slanted surface 103 of the shutter 98. When the box pin holder 83 is in the horizontal position to receive a box pin 28, the presser pin 101 is engaged by a fixed base 104 and is moved to cause the rounded end 102 to displace the shutter 98 until the hole 99 is aligned with the box pin support slot 89. An angular stopper 105 is pivotably supported by a pin on the holder body 86 for keeping the box pin support 87 spaced from the holder body 86 to spread the box pin support slot 89. More specifically, the stopper 105 can be angularly moved about its pin into engagement with the box pin supoprt 87 to hold the same spaced from the holder body 86 as shown in FIG. 15. When the box pin holder 83 is swung to the horizontal position, the stopper 105 is engaged by the fixed base 104 to turn out of engagement with the box pin support 87, which is then displaced toward the holder body 86 under the force of the spring 92 to restore the box pin support slot 89. The die assembly 84 also includes a locking lever 106 pivotably mounted on the die 93 and having a hooked end 107 lockingly engageable with the box pin support 87.

Figure 13:
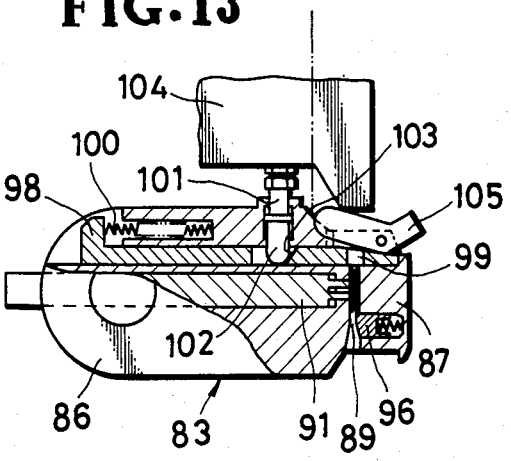
FIGS. 13 through 16 are side elevational views, with parts in cross section, of the box pin attachment unit, showing a process of attaching a box pin to a slide fastener stringer.
Figure 14:
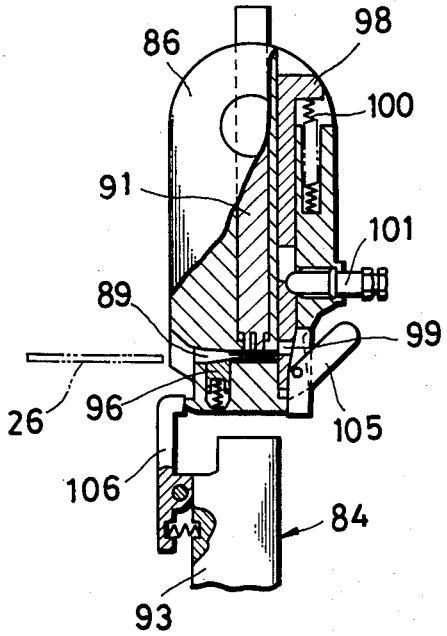
Figure 16:
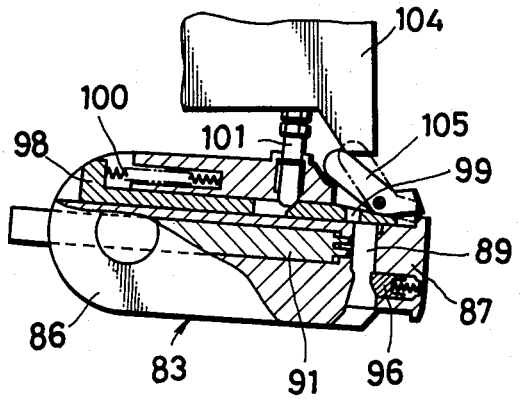
Figure 17:
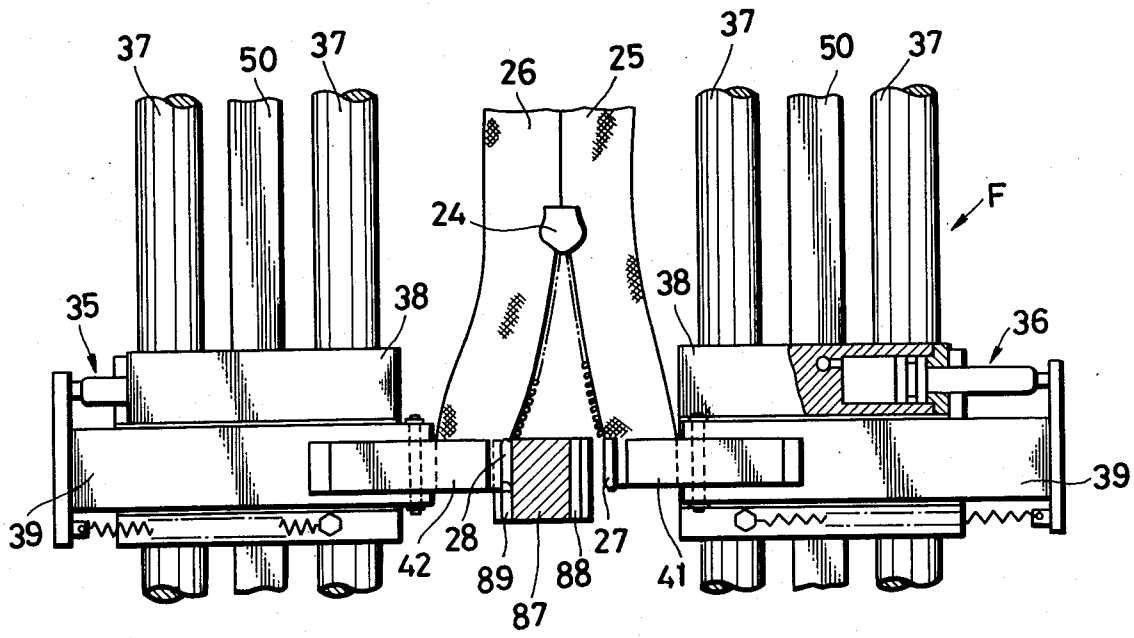
FIG. 17 is a plan view of the gripper mechanism positioned at the time of attaching a box pin.

FIGS. 13 through 16 illustrate the progressive steps of applying a box pin 28 to a slide fastener stringer. In FIG. 13, the box pin holder 83 is in the horizontal position in which the stopper 105 is engaged by the fixed base 104 to disengage from the box pin support 87, thus restoring the box pin support slot 89. The presser pin 102 is also engaged by the fixed base 104 to displace the shutter 98 until the hole 99 is held in registration with the box pin support slot 89. The box pin 28 is supplied from the chute 81 (FIG. 11) into the box pin support slot 89. The box pin holder 83 is then angularly moved to the vertical position of FIG. 14 in which the shutter 98 is displaced upwardly under the force of the compression spring 100. The box pin 28 is retained in the box pin support slot 89 by the shutter 98 and the gate 96, with the stringer 26 being about to enter a slot in the box pin 28. At this time, as shown in FIG. 17, the stringers 25, 26 are spread apart by the grippers 35, 36, such that the stringer 26 is inserted into the slot in the box pin 28 supported in the box pin support slot 89, with the stringer 25 to which the pin 27 has been attached being laterally spaced from the box pin support 87. Then, the die 93 is raised to press the box pin support 87 and the punch 91 is lowered to apply the box pin 28 to the stringer 26. In FIG. 15, the die 93 is lowered to cause the locking lever 106 to pull the box pin support 87 downwardly to spread the box pin support slot 89. As the box pin support 87 is depressed, the gate 96 is also lowered, and the stopper 105 engages the box pin support 87 to keep the box pin support slot 89 spread widely. Then, the box pin holder 83 is angularly moved to the horizontal position as shown in FIG. 16, whereupon the stringer 26 with the box pin 28 applied is extracted from the box pin support slot 89. The stringers 25, 26 are then fed again by the grippers 35, 36. In FIG. 16, the stopper 105 is engaged by the fixed base 104 to allow the box pin support 87 to be displaced toward the holder body 86, and the presser pin 101 is about to displace the shutter 98 to bring the hole 99 into registration with the box pin support slot 89.

Figure 18:
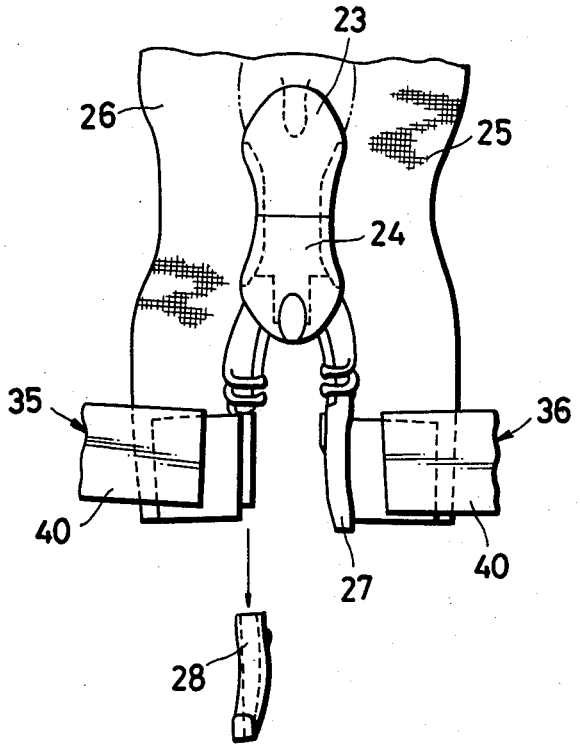
FIG. 18 is a fragmentary plan view of a slide fastener prior to attachment of a box pin thereto.

FIG. 18 shows the condition in which the stringers 25, 26 with the sliders 23, 24 mounted thereon and the pin 27 attached to the stringer 25 are spread apart by the grippers 35, 36, and the box pin 28 is about to be attached to the stringer 26.

After the pin 27, the first and second sliders 23, 24, and the box pin 28 are mounted on the stringers 25, 26, the stringers 25, 26 are cut off by the cutter unit E across an element-free space (not shown) to produce a bidirectionally openable slide fastener of a desired length. Bidirectionally openable slide fasteners with right-hand and left-hand pins can be manufactured as desired on the apparatus 20 of the invention by selecting one of the pin supply feeders 29, 30 to feed a pin 27 to the pin attachment unit A for attachment to one of the stringers 25, 26 and also selecting one of the box pin supply feeders 33, 34 to feed a box pin 28 to the box pin attachment unit D for attachment to the other stringer. The pin supply feeders 29, 30 and the box pin supply feeders 33, 34 can be selected by electrically or mechanically transmitting a command to them in timed relation to operation of the attachment units A, D.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for manufacturing a bidirectionally openable slide fastener, comprising:

(a) a gripper mechanism for gripping and feeding a pair of slide fastener stringers along a feed path;

(b) a pin attachment unit disposed on said feed path for attaching a pin to an end of one of said slide fastener stringers;

(c) a first slider attachment unit disposed on said feed path for threading a first slider over said slide fastener stringers;

(d) a second slider attachment unit disposed on said feed path for threading a second slider over said slide fastener stringers;

(e) a box pin attachment unit disposed on said feed path for attaching a box pin to an end of the other slide fastener stringer; and (f) a cutter unit disposed on said feed path for cutting off said slide fastener stringers across an element-free space to produce a completed bidirectionally openable slide fastener.

2. An apparatus according to claim 1, including a pair of pin feeders having chutes extending therefrom and coupled to said pin attachment unit, said pin attachment unit comprising a pivotable pin holder and a die assembly, said pin holder being angularly movable between a first position in which said pin holder receives the pin from one of said chutes and a second position in which said pin holder and said die assembly coact with each other to attach the pin to the end of said one of the slide fastener stringers.

3. An apparatus according to claim 2, said pin holder being composed of a holder body, a pin support movably supported on said holder body and having a pair of pin support slots opening toward said holder body for selectively receiving the pin, a pair of punches slidably mounted in said holder body in alignment with said pin support slots, respectively, and a spring acting between said holder body and said pin support for normally urging said pin support toward said holder body, said die assembly including a die movable toward said pin support for pressing the pin support against said holder body and a die holder holding said die.

4. An apparatus according to claim 1, including a pair of first and second slider feeders having chutes coupled to said first and second slider attachment units, respectively, each of said first and second slider attachment units comprising a pivotable slider feeder and a slider holder, said slider feeder being angularly movable between a first position to receive the slider from one of said chutes and a second position to cooperate with said slider holder in attaching the slider to said slide fastener stringers.

5. An apparatus according to claim 1, including a pair of box pin feeders having chutes extending therefrom and coupled to said box pin attachment unit, said box pin attachment unit comprising a pivotable box pin holder and a die assembly, said box pin holder being angularly movable between a first position in which said box pin holder receives the box pin from a selected one of said chutes and a second position in which said box pin holder and said die assembly coact with each other to attach the box pin to the end of said other slide fastener stringer.

6. An apparatus according to claim 5, said box pin holder being composed of a holder body, a box pin support movably supported on said holder body and having a pair of box pin support slots opening toward said holder body for selectively receiving the box pin, a pair of punches slidably mounted in said holder body in alignment with said pin support slots, respectively, and a spring acting between said holder body and said box pin support for normally urging said box pin support toward said holder body, said die assembly including a die movable toward said box pin support for pressing the box pin support against said holder body and a die holder holding said die.

7. An apparatus for manufacturing a bidirectionally openable slide fastener, comprising:

(a) a gripper mechanism for gripping and feeding a pair of slide fastener stringers along a feed path;

(b) a pin attachment unit disposed on said feed path for attaching a pin to an end of one of said slide fastener stringers;

(c) a first slider attachment unit disposed on said feed path for threading a first slider over said slide fastener stringers;

(d) a second slider attachment unit disposed on said feed path for threading a second slider over said slide fastener stringers;

(e) a box pin attachment unit disposed on said feed path for attaching a box pin to an end of the other slide fastener stringer, said box pin attachment unit having a pivotable box holder and a die assembly;

(f) a pair of box pin feeders having chutes extending therefrom and coupled to said box pin attachment unit;

(g) said box pin holder being angularly movable between a first position in which said box pin holder receives the box pin from one of said chutes and a second position in which said box pin holder and said die assembly coact with each other to attach the box pin to the end of said other slide fastener stringer;

(h) said box pin holder being composed of (1) a holder body, (2) a box pin support movably supported on said holder body and having a pair of box pin support slots opening toward said holder body for selectively receiving the box pin, (3) a pair of punches slidably mounted in said holder body in alignment with said pin support slots, respectively, and (4) a spring acting between said holder body and said box pin support for normally urging said box pin support toward said holder body;

(i) said box pin holder further comprising (1) a gate slidably mounted in said box pin support and normally urged resiliently into each of said box pin support slots, (2) a shutter slidably supported in said holder body and said box pin support and extending across each of said box pin support slots, said shutter having a hole therethrough, (3) a spring acting between said holder body and said shutter for normally urging said shutter in a direction to displace said hole out of registration with each said box pin support slot, whereby said gate and said shutter can retain the box pin in each said box pin support slot, and (4) a presser pin movably mounted on said holder body and engageable with a fixed base to displace said shutter to bring said hole into registration with each said box pin support slot, when said box pin holder is in said first position;

(j) said die assembly including (1) a die movable toward said box pin support for pressing the box pin support against said holder body, and (2) a die holder holding said die; and (k) a cutter unit disposed on said feed path for cutting off said glide fastener stringers across an element-free space to produce a completed bidirectionally openable slide fastener.

8. An apparatus for manufacturing a bidirectionally openable slide fastener, comprising:

(a) a gripper mechanism for gripping and feeding a pair of slide fastener stringers along a feed path;

(b) a pin attachment unit disposed on said feed path for attaching a pin to an end of one of said slide fastener stringers;

(c) a first slider attachment unit disposed on said feed path for threading a first slider over said slide fastener stringers;

(d) a second slider attachment unit disposed on said feed path for threading a second slider over said slide fastener stringers;

(e) a box pin attachment unit disposed on said feed path for attaching a box pin to an end of the other slide fastener stringer, said box pin attachment unit having a pivotable box holder and a die assembly;

(f) a pair of box pin feeders having chutes extending therefrom and coupled to said box pin attachment unit;

(g) said box pin holder being angularly movable between a first position in which said box pin holder receives the box pin from one of said chutes and a second position in which said box pin holder and said die assembly coact with each other to attach the box pin to the end of said other slide fastener stringer;

(h) said box pin holder being composed of (1) a holder body, (2) a box pin support movably supported on said holder body and having a pair of box pin support slots opening toward said holder body for selectively receiving the box pin, (3) a pair of punches slidably mounted in said holder body in alignment with said pin support slots, respectively, and (4) a spring acting between said holder body and said box pin support for normally urging said box pin support toward said holder body;

(i) said box pin holder having a stopper angularly movably supported on said holder body and engageable with said box pin support to spread each said box pin support slot, said stopper being engageable with a fixed base to release said box pin support for allowing said box pin support to move toward said holder body to restore each said box pin support slot, when said box pin holder is in said first position;

(j) said die assembly including (1) a die movable toward said box pin support for pressing the box pin support against said holder body, (2) a die holder holding said die, and (3) a locking lever for lockingly engaging said box pin support to keep said box pin support away from said holder body thereby spreading each said box pin support when said box pin holder is in said second position; and (k) a cutter unit disposed on said feed path for cutting off said slide fastener stringers across an element-free space to produce a completed bidirectionally openable slide fastener.

* * * * *